United States Patent [19]

Smith

[11] 4,428,754

[45] Jan. 31, 1984

[54] N, N-BIS (HYDROXYALKYL) ALKYL AMIDES AS PHASE SEPARATION INHIBITORS IN LIQUID HYDROCARBON AND ETHANOL MIXTURES

[75] Inventor: Harry A. Smith, Midland, Mich.

[73] Assignee: The Dow Chemical Company, Midland, Mich.

[21] Appl. No.: 353,134

[22] Filed: Mar. 1, 1982

[51] Int. Cl.[3] ..... C10L 1/22

[52] U.S. Cl. ..... 44/56; 44/53; 44/71

[58] Field of Search ..... 44/56, 71, 70

[56] References Cited

U.S. PATENT DOCUMENTS

| | | | |
|---|---|---|---|
| 2,736,641 | 2/1956 | Mattson et al. | 44/71 |
| 3,533,955 | 10/1970 | Pader et al. | 252/153 |
| 4,328,004 | 5/1982 | Globus | 44/56 |

OTHER PUBLICATIONS

McCutcheon's, "Detergents and Emulsifiers," North American Edition, 1978 Annual, p. 226.

*Primary Examiner*—Charles F. Warren
*Assistant Examiner*—Y. Harris-Smith
*Attorney, Agent, or Firm*—Norman L. Sims; Douglas N. DeLine

[57] ABSTRACT

This invention is a method of preventing phase separation of hydrous ethanol and liquid hydrocarbon fuels comprising the addition of an effective amount of a phase separation inhibitor selected from the group of N,N-bis(hydroxyalkyl)alkyl amide represented by the formula:

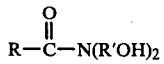

wherein R is a $C_{10-20}$ alkyl group and R′ is a $C_{1-5}$ alkylene group.

15 Claims, No Drawings

N, N-BIS (HYDROXYALKYL) ALKYL AMIDES AS PHASE SEPARATION INHIBITORS IN LIQUID HYDROCARBON AND ETHANOL MIXTURES

BACKGROUND OF THE INVENTION

This invention relates to novel fuel mixtures for use in engines which use liquid hydrocarbon fuels and to novel processes to prevent phase separation in liquid hydrocarbon fuel and hydrous ethanol mixtures. More particularly, the invention relates to solubilizing ethanol which contains water in liquid hydrocarbon fuels, including gasoline, by means of additives which have no adverse effect on storage, stability, water-shedding or corrosion properties.

The use of commercial ethanol in liquid hydrocarbon fuels such as in gasoline blends commonly referred to as "gasohol", can cause a phase separation problem because of the limited solubility of water/ethanol mixtures in liquid hydrocarbons, particularly in low aromatic content gasolines.

A major cause of this problem is the tendency of ethanol to absorb water. Additionally, industrial grade ethanol commonly used in gasohol contains 5 percent by weight of water. The water causes the ethanol in liquid hydrocarbon fuel mixtures to separate into a second phase, particularly at low temperatures. This phase separation may also result in corrosion problems and poor combustion performance in the engine.

The literature discloses compositions which solubilize hydrous ethanol in the gasoline. Such compositions include alkyl t-butyl ethers such as methyl t-butyl ether, ethyl t-butyl ether and higher molecular weight distillation bottoms disclosed by U.S. Pat. Nos. 4,207,077 and 4,207,076, respectively.

One of the principal objects of this invention is to provide an improved liquid hydrocarbon fuel composition wherein the liquid hydrocarbon and ethanol components are maintained in a single phase by a phase separation inhibitor.

Another object is to provide a phase separation inhibitor for liquid hydrocarbon fuel and hydrous ethanol mixtures which is effective at very low weight percentages and is economical to use. A further object is to inhibit this separation at temperatures as low as −40° C. to allow the effective use of liquid hydrocarbon fuel and hydrous ethanol mixtures in cold climates such as the northern United States.

SUMMARY OF THE INVENTION

This invention is a method of preventing the phase separation of hydrous ethanol and liquid hydrocarbon fuel mixtures comprising adding to the solution an effective amount of a phase separation inhibitor selected from the group of N,N-bis(hydroxyalkyl)alkyl amides (hereinafter referred to as dihydroxy amides) represented by the formula:

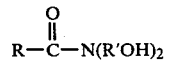

$$R-\overset{\overset{\displaystyle O}{\|}}{C}-N(R'OH)_2$$

wherein R is a $C_{10-20}$ alkyl group and R′ is separately in each occurrence a $C_{1-5}$ lower alkylene group.

The invention is further a gasohol composition in which phase separation is inhibited comprising gasohol and an effective amount of a phase separation inhibitor selected from the group of dihydroxy amides defined above.

DETAILED DESCRIPTION OF THE INVENTION

It has been discovered that dihydroxy amides exhibit good phase separation inhibition characteristics in liquid hydrocarbons and hydrous ethanol mixtures.

A method for inhibiting phase separation in a mixture of a liquid hydrocarbon fuel and hydrous ethanol comprises contacting the mixture with an effective amount of a phase separation inhibitor selected from the group of dihydroxy amides defined above.

Preferred dihydroxy amides are those wherein R′ is ethylene and R is a straight chained $C_{16-20}$ alkyl. The most preferred dihydroxy amide phase separation inhibitor is N,N-bis(2-hydroxyethyl)octadecane amide.

Liquid hydrocarbon fuel shall mean herein hydrocarbon distillates distillable at atmospheric pressure where the 90 percent point is about 675° F. or less, preferably about 640° F. or less. Most preferably the 90 percent evaporated endpoint is about 400° F. or less. Examples of these liquid hydrocarbon fuels include aviation gasolines, motor gasolines, diesel fuel oils, aviation turbine fuels, gas-turbine fuel oils, farm tractor fuels, etc. These terms are defined in *Kirk-Othmer Encyclopedia of Chemical Technology,* 2nd Ed., Vol. 15, pp. 77–92, "Petroleum Products", incorporated herein by reference. The preferred liquid hydrocarbon fuels are those having a utility as fuel in internal combustion engines, most preferable are motor gasolines.

A liquid hydrocarbon fuel commonly mixed with hydrous ethanol is automotive gasoline. The mixture of automotive gasolines and hydrous ethanol is commonly known as gasohol. The gasoline content is usually between 80 and 99 percent by weight with a hydrous ethanol content between about 1 and 20 percent. The ethanol, by the time of ultimate use, has about 5 percent by weight of water in it due to its water absorptive characteristics, but it could have as much as or even more than 12 percent water and is therefore referred to as hydrous ethanol. Preferred according to the invention is gasohol comprising about 90 percent by weight of gasoline and 10 percent by weight of hydrous ethanol, which comprises about 95 percent by weight of ethanol and 5 percent by weight of water.

The amount of inhibitor required is dependent upon the temperature to which the liquid hydrocarbon fuel and hydrous ethanol mixture will be subjected. As the temperature decreases, more inhibitor is required to prevent phase separation.

It is preferable that the phase separation inhibitor be effective at 0° C., more preferable that it be effective at −20° C., and most preferable that it be effective at −40° C.

Further, the amount of inhibitor required to prevent phase separation depends upon the effectiveness of the particular inhibitor used. An effective amount of inhibitor is preferably between 0.05 and 10.0 percent by weight of liquid hydrocarbon fuel and hydrous ethanol mixture and is most preferably between 0.1 and 1.0 percent by weight of the liquid hydrocarbon fuel and hydrous ethanol mixture.

EXAMPLE 1

Unleaded gasoline (30.0 g) was mixed with 3.3 g of 78.9 percent ethanol (21.1 percent water) and 2.0 g of N,N-bis(2-hydroxyethyl)octadecane amide. This mixture of about 48 ml was analyzed for the amount of the water-ethanol phase at 20° C., 0° C., −40° C. and −60° C. The result is shown in Table I.

TABLE I

| Phase Separation Inhibitor | Amount of Second Phase (ml) | | | |
|---|---|---|---|---|
| | 20° C. | 0° C. | −40° C. | −60° C. |
| N,N—bis(2-hydroxyethyl)octadecane amide | 0 | 0 | 0 | 0.02 |

EXAMPLE 2

Varying amounts of N,N-bis(2-hydroxyethyl)octadecane amide were added to commercially available gasohol, 90 percent gasoline, 9.59 percent hydrous ethanol, and 0.41 percent water, to determine the minimum weight percentage at which the compound would be effective at −40° C. This compound was effective at a concentration of 0.2 percent by weight of the gasohol at −40° C.

EXAMPLE 3

A commercially obtained gasohol composition, 90 percent gasoline, 9.59 percent ethanol and 0.41 percent water, was examined for phase separation at reduced temperatures. Phase separation occurred between −10° C. and −20° C.

EXAMPLE 4

Unleaded gas (30 g) was mixed with 3 g of hydrous ethanol (88.7 percent ethanol and 11.3 percent water), to give a sample of about 48 ml. The sample was examined for the amount of a second phase at 20° C. 0.4 ml Of a second phase was observed.

What is claimed is:

1. A method for preventing a mixture of hydrous ethanol and a liquid hydrocarbon fuel from separating into two phases comprising adding to the solution an effective amount of a phase separation inhibitor wherein the inhibitor is a N,N-bis(hydroxyalkyl)alkyl amide represented by the formula:

$$R-\overset{\overset{\displaystyle O}{\|}}{C}-N(R'OH)_2$$

wherein R is a $C_{10-20}$ alkyl group and R′ is a $C_{1-5}$ akylene group.

2. The method of claim 1 wherein the amount of phase separation inhibitor added is between about 0.05 to about 10.0 percent by weight of hydrocarbon fuel and hydrous ethanol solution.

3. The method of claim 2 wherein the amount of phase separation inhibitor added is between about 0.1 and about 1.0 percent by weight of hydrocarbon fuel and hydrous ethanol solution.

4. The method of claim 1 wherein R′ is ethylene and R is a straight chained $C_{16-20}$ alkyl group.

5. The method of claim 4 wherein the phase separation inhibitor is N,N-bis(2-hydroxyethyl)octadecane amide.

6. The method of claim 1 wherein the liquid hydrocarbon fuel has utility as a fuel for an internal combustion engine.

7. The method of claim 6 wherein the liquid hydrocarbon fuel is gasoline.

8. The method of claim 1 wherein the phase separation inhibitor is effective above about 0° C.

9. The method of claim 1 wherein the phase separation inhibitor is effective above a temperature of about −20° C.

10. The method of claim 1 wherein the phase separation inhibitor is effective above a temperature of about −40° C.

11. A gasohol composition in which phase separation is inhibited comprising a gasohol solution having added thereto from about 0.05 and 10.0 percent by weight of the gasohol, a N,N-bis(hydroxyalkyl)alkyl amide represented by the formula:

$$R-\overset{\overset{\displaystyle O}{\|}}{C}-N(R'OH)_2$$

wherein R is a $C_{10-20}$ alkyl group and R′ is a $C_{1-5}$ alkylene group.

12. The composition of claim 11 wherein the amount of phase separation inhibitor added is from about 0.1 to about 1.0 percent by weight of the gasohol.

13. The composition of claim 11 or 12 wherein the gasohol comprises between about 80 percent and 99 percent by weight gasoline and between about 1 percent and 20 percent by weight hydrous ethanol.

14. The composition of claim 13 wherein the gasohol comprises about 90 percent by weight gasoline and about 10 percent by weight hydrous ethanol.

15. The composition of claim 14 wherein the hydrous ethanol comprises about 95 percent by weight ethanol and about 5 percent by weight water.

* * * * *